US006041524A

United States Patent [19]

Brooks

[11] Patent Number: 6,041,524

[45] Date of Patent: Mar. 28, 2000

[54] FOOTWEAR HAVING RECESSED HEEL CUP

[75] Inventor: Jeffrey S. Brooks, St. Louis County, Mo.

[73] Assignee: Jeffrey S. Brooks, Inc., Creve Coeur, Mo.

[21] Appl. No.: 09/166,357

[22] Filed: Oct. 5, 1998

[51] Int. Cl.[7] ..... A43B 7/14; A43B 23/28

[52] U.S. Cl. ..... 36/93; 36/69; 36/58.5; 36/71

[58] Field of Search ..... 36/92, 93, 95, 36/69, 71, 58.5, 105

[56] References Cited

U.S. PATENT DOCUMENTS

| | | |
|---|---|---|
| 1,020,160 | 3/1912 | Rowe . |
| 1,055,768 | 3/1913 | Levee et al. . |
| 1,137,092 | 4/1915 | Sharp . |
| 2,119,807 | 6/1938 | Farley . |
| 2,821,032 | 1/1958 | Helfet . |
| 3,068,872 | 12/1962 | Brody . |
| 3,309,797 | 3/1967 | Poitras . |
| 3,333,353 | 8/1967 | Garcia . |
| 4,272,899 | 6/1981 | Brooks . |
| 4,435,910 | 3/1984 | Marc . |
| 4,503,576 | 3/1985 | Brown . |
| 4,627,178 | 12/1986 | Sullivan et al. . |
| 4,702,255 | 10/1987 | Schenkl . |
| 4,726,126 | 2/1988 | Bernhard . |
| 4,739,765 | 4/1988 | Sydor et al. . |
| 4,869,001 | 9/1989 | Brown . |
| 4,879,821 | 11/1989 | Graham et al. . |
| 4,901,390 | 2/1990 | Daley . |

FOREIGN PATENT DOCUMENTS

| | | |
|---|---|---|
| 1222370 | 6/1960 | France . |
| 0 350 517 | 1/1990 | Germany . |

OTHER PUBLICATIONS

Comed advertisement "The Power of 78" in "Podiatry Today" Oct. 1993, p. 39.

Bloch Orthotic Labs advertisement "Shelling Out Too Much for Orthotics?" in "Podiatric Products" Sep. 1994, p. 10.

Ipos Orthopedics North America Inc. advertisment "Soft–Base Soft–Ipocon" in "Podiatric Products" Sep. 1994, p. 37.

M–F Athletic Company advertisement "If Achilles was Alive, He'd Want a Pair of M–F Heel Protectors!" in "Podiatric Products" Sep. 1994, p. 55.

Johnson & Johnson advertisement "Johnson & Johnson Biomechanics" in "Biomechanics" Sep. 1995, p. 1.

Riecken's Orthotic Laboratory advertisement "Our Dealers Become Old Friends . . . " in "Biomechancis" Sep. 1995, p. 16.

Darco advertisement "The One Stop Footcare Shop!" in "Biomechanics" Sep. 1995, p. 18.

IEM Medical Technologies, Inc. advertisement "Sorbothane II® Heel Cups" in "Biomechanics" Sep. 1995, p. 66.

Bio–Orthopaedic Laboratory advertisement "Standard Foot Orthotics" and The Foot Store advertisement "The Best Kind of Support . . . " in "Biomechanics" Sep. 1995, p. 76.

(List continued on next page.)

*Primary Examiner*—M. D. Patterson

*Attorney, Agent, or Firm*—Senniger, Powers, Leavitt & Roedel

[57] ABSTRACT

Footwear including a sole having a front and a back for supporting a bottom of a foot. A heel cup at the back of the sole receives and supports a heel of the foot. The heel cup has a bottom for further supporting the bottom of the foot and a side wall extending up from the bottom. The side wall has a generally concave rear section for receiving and supporting the back of the heel and opposite side sections extending forward from the rear section. The recess in the rear section of the side wall of the heel cup is offset laterally from a longitudinal central vertical plane of the heel cup. The recess is sized for accommodating the rearwardly protruding lateral posterior portion of the calcaneus of the foot.

11 Claims, 12 Drawing Sheets

OTHER PUBLICATIONS

STJ Orthotic Services Inc. advertisement "Your Heel Pain Patients will be Floating on Water" in "Podiatry Management" Jun. 1996, p. 1

The Elford Group Ltd. advertisement "Nothing Fits Like SOCS™" in "Podiatry Management" Jun. 1996, p. 47.

CJ Foot Orthotics advertisement "All This For Less" in "Podiatry Management" Jun. 1996, p. 101.

Bauerfeind advertisement"Viscoheel®, the viscoelastic heel cushions . . . " in "Biomechanics" Jan. 1997, p. 57.

Ortho–Dynactive, Inc. advertisement "Tread Lightly" in "Biomechanics" Jan. 1997, p. 71.

Bird & Cronin Inc. advertisement "A Complete Line of Pre–Molded Silicone Foot Orthotics" in "Biomechanics" Jun. 1997, p. 44.

Bolt Systems, Inc. advertisement "Quality Prefabricated Orthopedic Appliances" in "Biomechanics" Jun. 1997, p. 74.

"Biomechanics" Jun. 1997, p. 87.

Dr. Scholl's® advertisement "Now Your Patients are One Step Closer to Pain Relief" in "Podiatry Today" Jul./Aug. 1997, p. 33.

AliMed® advertisement "Your best single source . . . " in "Podiatry Today" Jul./Aug. 1997, p. 43.

Performance Materials Corporation advertisement "Into the Deep Blue" in "Podiatry Today" Jul./Aug. 1997, p. 44.

Allied OSI Labs advertisement "Allied OSI Footlights are Light in Price" in "Podiatry Today" Jul./Aug. 1997, p. 84.

FOOTWEAR HAVING RECESSED HEEL CUP

BACKGROUND OF THE INVENTION

The present invention relates generally to footwear and more particularly to footwear having a recess in a heel cup for accommodating rearwardly projecting features of a foot.

In typical footwear, a counter positioned at the back of the footwear surrounds the heel to retain the foot in position inside the footwear when walking or running. As the foot moves inside the footwear, the counter exerts pressure on features of the heel including the calcaneus (i.e., the heel bone), the Achilles tendon, and the bursae adjacent the tendon. The heel also moves relative to the counter, causing friction between the counter and the skin in the region of the heel. Sometimes the pressure and friction cause ailments such as bursitis and Achilles tendinitis, as well as swelling and irritation of the skin and underlying tissue. Some conventional footwear includes extra padding in the counter to alleviate these ailments. However, the padding wears out over time and becomes less effective in alleviating the ailments. Moreover, the extra padding in conventional footwear is not precisely anatomically positioned for alleviating the ailments.

Another problem associated with conventional footwear is that it does not conform to the structure of the foot because counters of conventional footwear are not shaped like a heel. The rearward end of the heel bone is angled so that the lateral (i.e., outside) portion of the heel bone extends farther rearward than the medial (i.e., inside) portion. Moreover, the Achilles tendon and adjacent bursae extend farther rearward on the lateral side of the heel due to the angled rearward end of the heel bone. Thus, the structure of the foot is not symmetric. However, conventional counters are symmetric about a central longitudinal axis of the shoe. Because conventional footwear is not shaped to accommodate the heel, particularly the rearward lateral portion of the heel bone and the Achilles tendon and adjacent bursae, the ailments discussed above are more likely to occur. The present invention takes into account the structure of the foot to reduce the likelihood of such ailments.

SUMMARY OF THE INVENTION

Among the several objects and features of the present invention may be noted the provision of footwear which corresponds to the shape of a foot; the provision of footwear which reduces ailments associated with the heel of a foot; and the provision of footwear which is comfortable to wear.

Briefly, footwear of this invention includes a sole having a front and a back for supporting the bottom of a foot. A heel cup at the back of the sole receives and supports the heel of the foot. The heel cup has a bottom for supporting the bottom of the foot and a side wall extending up from the bottom. The side wall has a generally concave rear section for receiving and supporting the back of the heel and opposite side sections extending forward from the rear section. A recess in the rear section of the side wall of the heel cup is offset laterally from a longitudinal central vertical plane of the heel cup. The recess is sized for accommodating the rearwardly protruding lateral posterior portion of the calcaneus of the foot.

In another aspect of the invention, the footwear is an orthotic including a heel cup for receiving and supporting the heel of a foot. The heel cup has a bottom for supporting the bottom of the foot and a side wall extending up from the bottom. The side wall has a generally concave rear section for receiving and supporting the back of the heel and opposite side sections extending forward from the rear section. A recess in the rear section of the side wall of the heel cup is offset laterally from a longitudinal central vertical plane of the heel cup. The recess is sized for accommodating the rearwardly protruding lateral posterior portion of the calcaneus of the foot.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
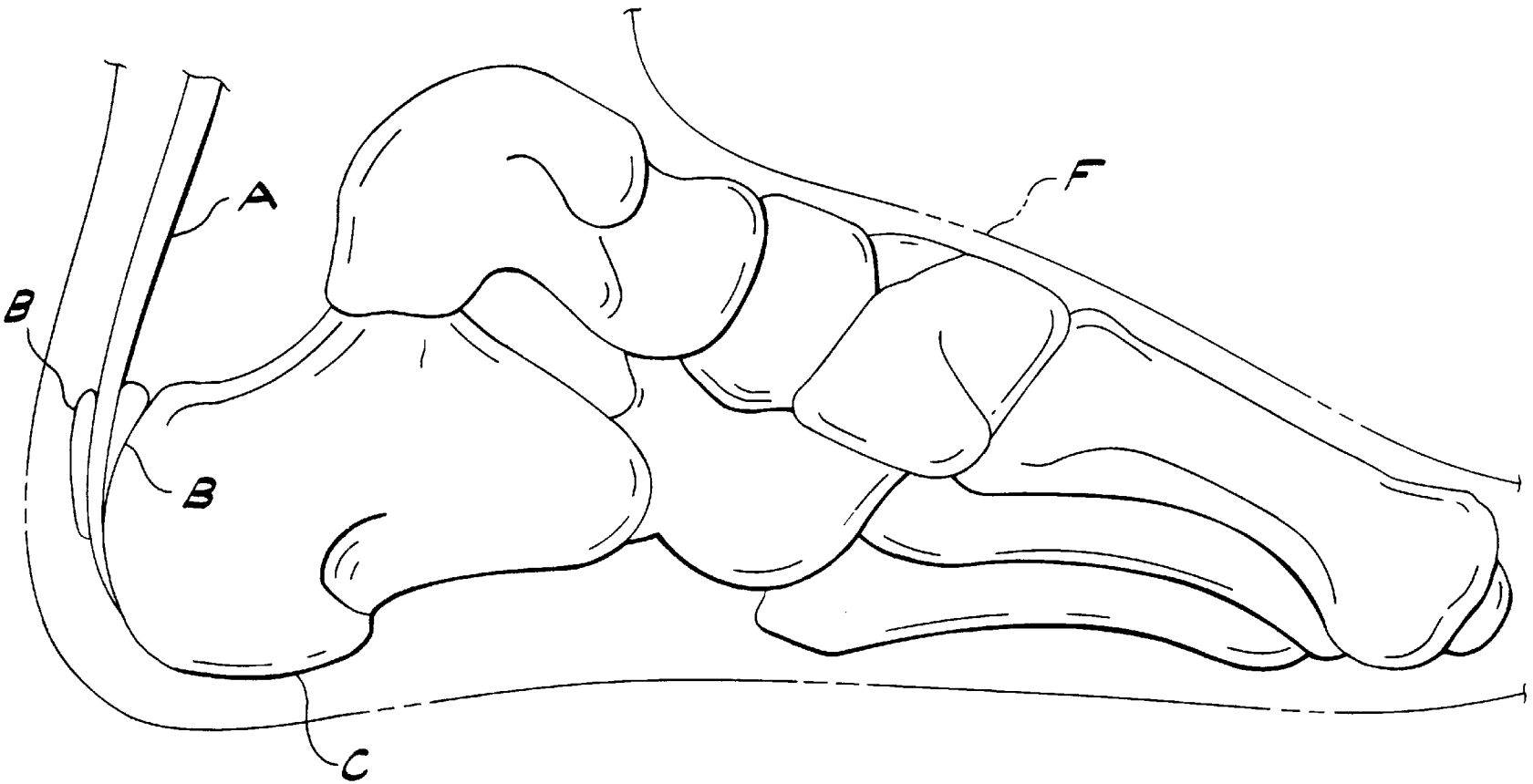
FIG. 1 is a partial right side (medial) elevation of bones, Achilles tendon, and bursae of a left foot.
Figure 2:
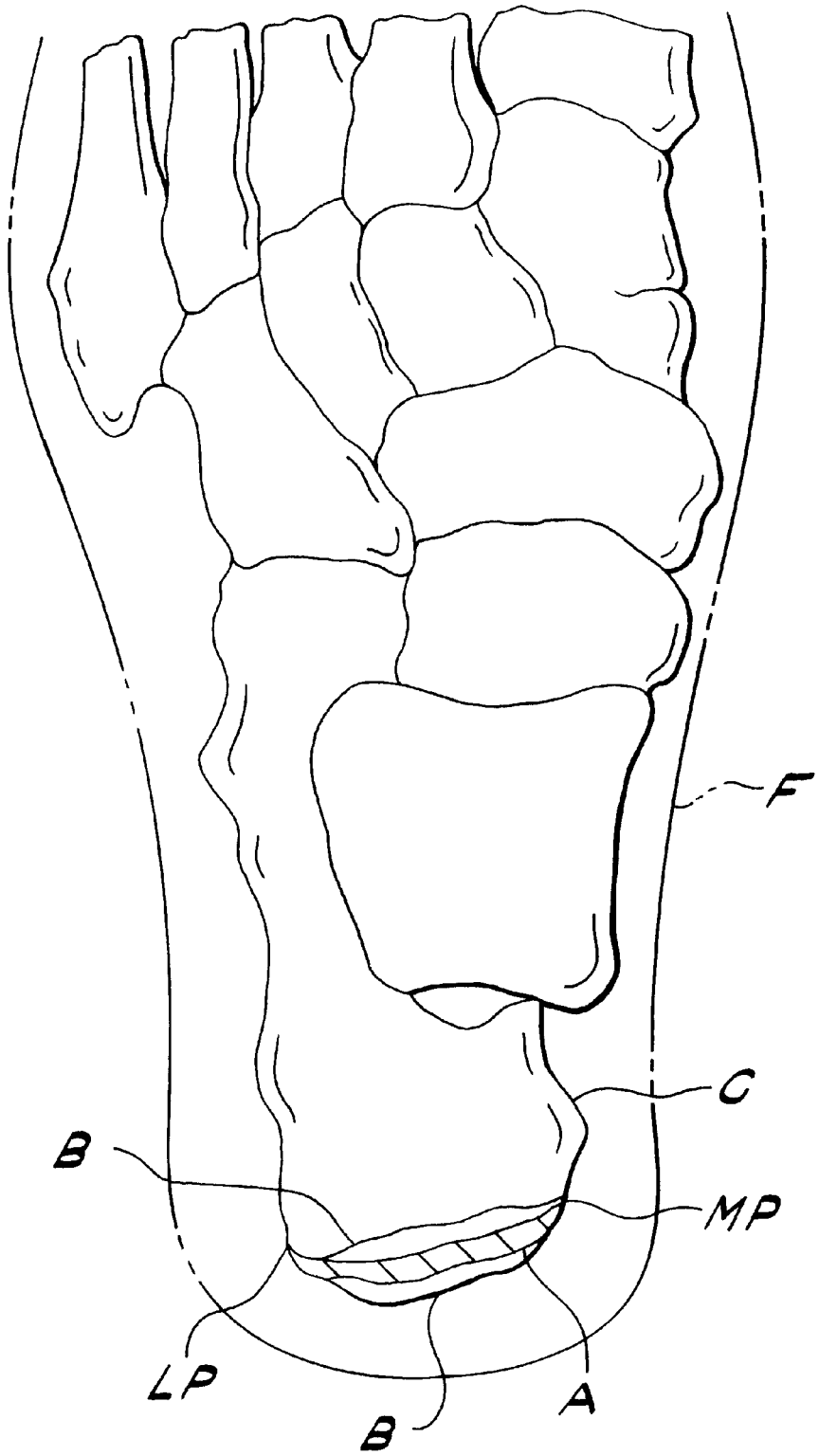
FIG. 2 is a partial top plan of the bones, tendon and bursae of the left foot in partial section.
Figure 3:
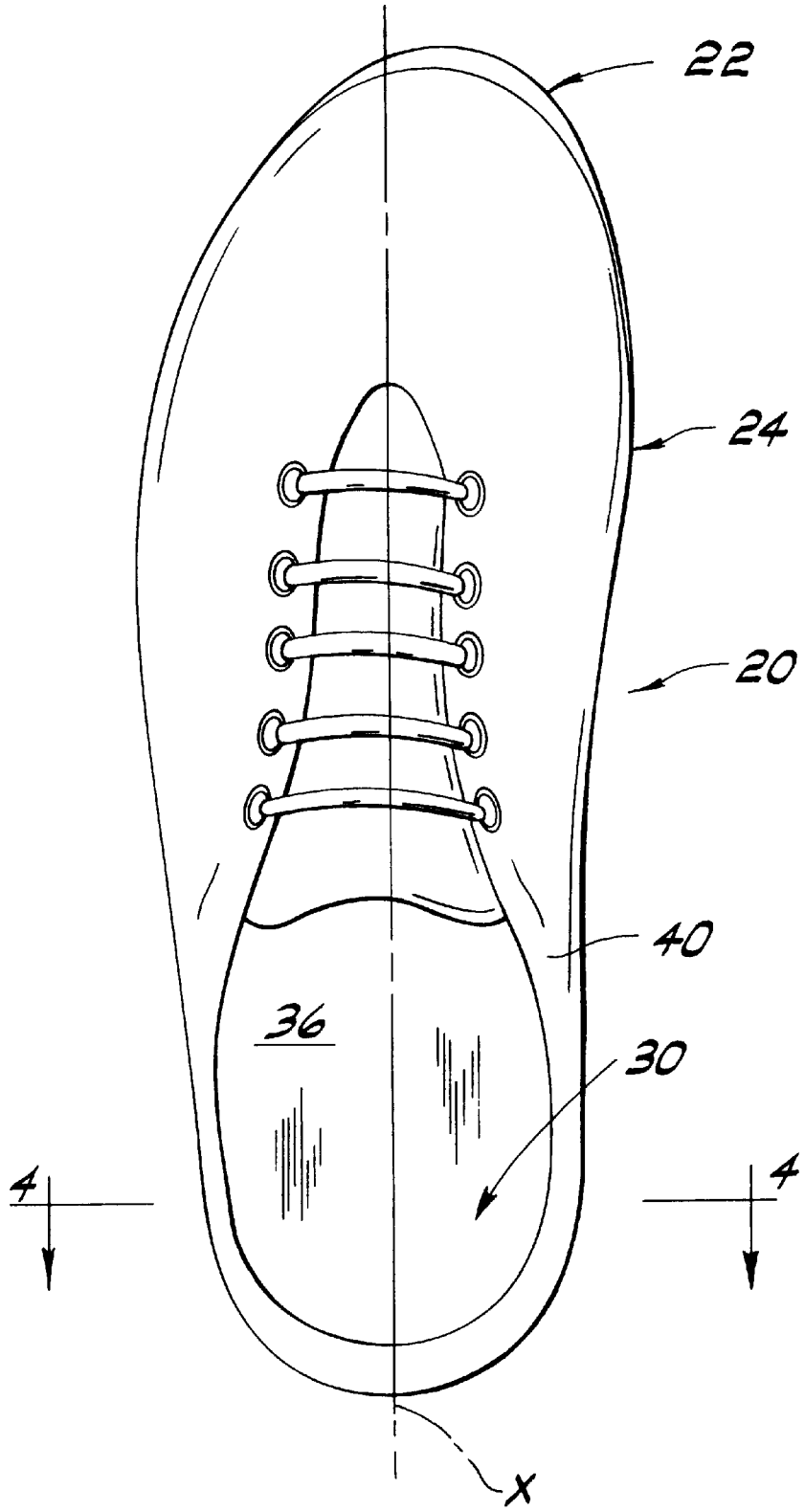
FIG. 3 is a top plan of a left shoe of the present invention.

Referring now to the drawings and in particular to FIGS. 1 and 2, a foot is designated in its entirety by the reference character F. The foot F has a heel bone or calcaneus C and an Achilles tendon A extending upward from a rearward end of the heel bone. Fluid-filled sacks or bursae B are positioned in front of and behind the tendon A just above the point where the tendon attaches to the heel bone C. As shown in FIG. 2, the rearward end of the heel bone C is angled so its lateral posterior portion LP protrudes farther rearward than its medial posterior portion MP.

FIGS. 3 through 6 illustrate a shoe, generally indicated at 20, constituting footwear of a first embodiment of the present invention. The shoe 20 has a sole (generally indicated at 22) and an upper (generally indicated at 24) attached to the sole about its periphery in a conventional manner. The sole 22 and upper 24 form a heel cup, generally indicated at 30, at the back of the shoe 20 for receiving the heel of a foot F (not shown). Although the footwear for the first embodiment is a shoe, those skilled in the art will appreciate the present invention applies to other types of footwear such as boots, sandals, orthotics and inserts for use with shoes.

Figure 4:
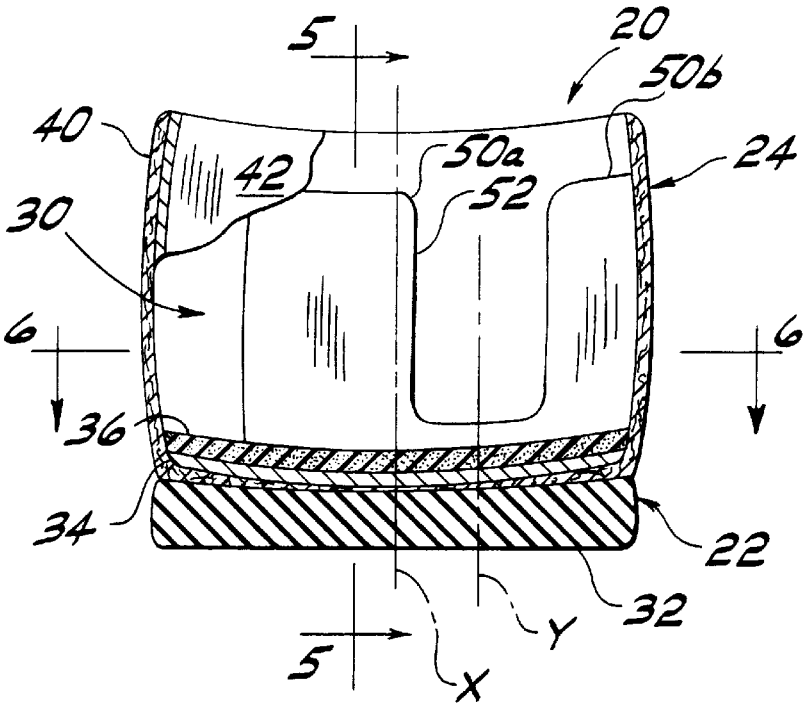
FIG. 4 is a cross section taken along line 4—4 of FIG. 3 showing a first embodiment of the present invention.
Figure 5:
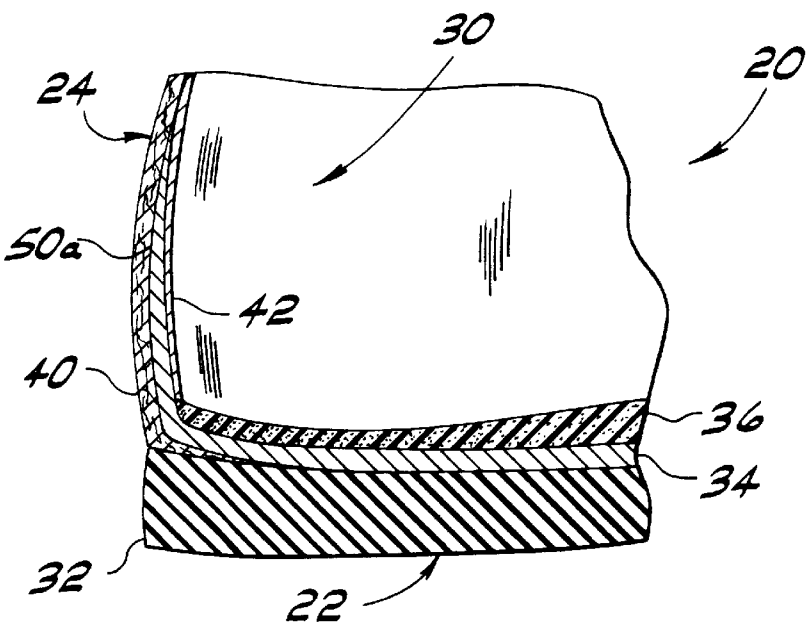
FIG. 5 is a cross section taken along line 5—5 of FIG. 4.

As illustrated in FIGS. 4 and 5, the sole 22 includes an outsole 32 having a lower surface which forms the bottom of the sole, a last board 34 affixed to the upper surface of the outsole and an insole 36 mounted on top of the last board. The upper 24 includes an outer shell 40 which forms the exterior of the shoe and a liner 42 inside the shell. The sole 22 and upper 24 constructions are conventional and will not be described in further detail. As will be appreciated by those skilled in the art, the sole 22 and upper 24 may have other constructions without departing from the scope of the present invention. For instance, it is contemplated that the upper 24 may include a rigid counter (not shown) immediately inside the outer shell 40 for stiffening the upper in the region surrounding the heel cup 30. In addition, a sockliner (not shown) may be provided over the upper surface of the insole 36.

Figure 6:
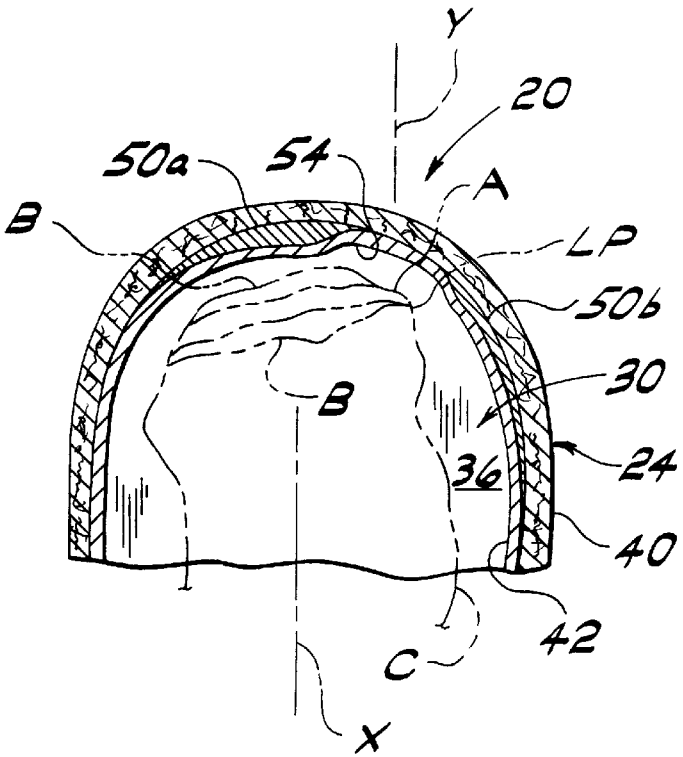
FIG. 6 is a cross section taken along line 6—6 of FIG. 4.
Figure 7:
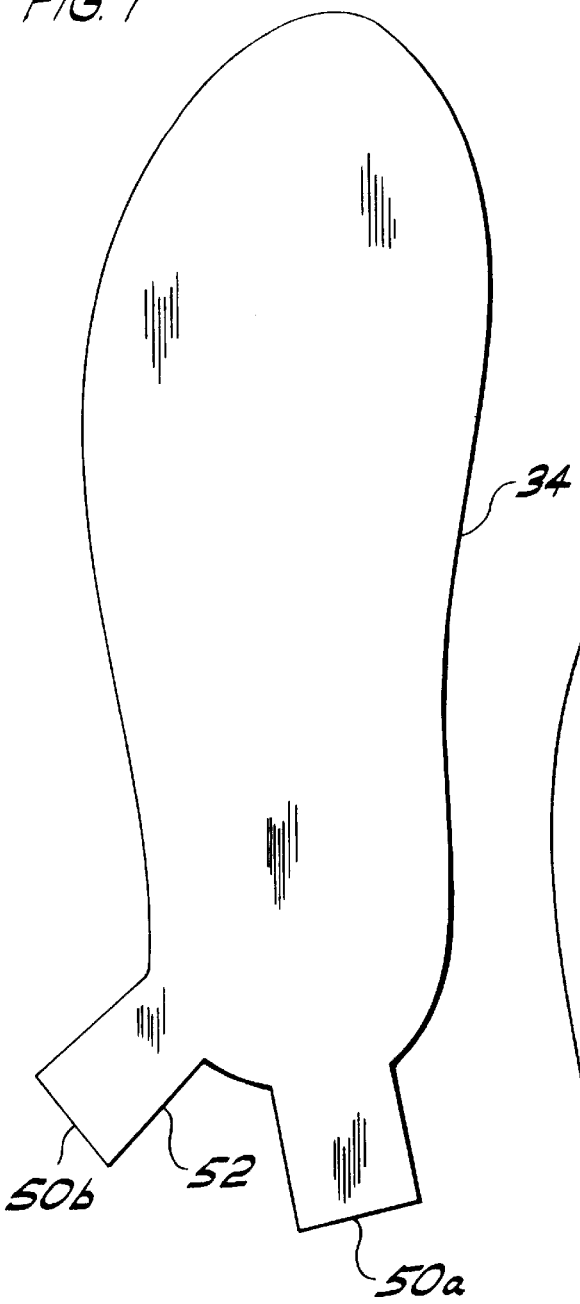
FIG. 7 is a top plan of a last board used in constructing the shoe of the first embodiment.

FIG. 7 illustrates the last board 34 used in constructing the shoe 20 of the first preferred embodiment. Two spaced tabs 50*a*, 50*b* extend from the rear edge of the last board 34. These tabs 50*a*, 50*b* are bent upward as shown in FIG. 5 when the shoe 20 is constructed so they lie between the outer shell 40 and liner 42 of the upper 24. A space 52 (FIG. 7) between the tabs 50*a*, 50*b* forms a recess 54 at the back of the heel cup 30 which is sized and positioned for receiving the lateral posterior portion LP of the heel bone C, the Achilles tendon A and the associated bursae B as illustrated in FIG. 6 and to reduce pressure on these features. The recess 54 is offset laterally from a longitudinal axis X bisecting the heel cup 30 so a portion of the foot F corresponding to the lateral posterior portion LP of the heel C protrudes into the recess 54. Although the recess 54 may have other widths without departing from the scope of the present invention, in the preferred embodiments, the recess has a width of between approximately 2.5 centimeters (cm) and approximately 3.5 cm, depending on the size of the shoe. Further, a centerline Y of the recess is offset from the longitudinal axis X of the heel cup 30 by between about 1.0 cm and about 2.0 cm, depending on the size of the shoe. In addition, although the recess 54 may have other depths without departing from the scope of the present invention, in the preferred embodiments, the recess has a depth of between approximately 0.05 cm and approximately 0.10 cm. As will be appreciated by those skilled in the art, these preferred dimensions will vary depending upon the materials used and the size of the shoe. Although other materials may be used without departing from the scope of the present invention, the last board 34 of the first preferred embodiment is made of neoprene, polyvinyl chloride or polyurethane.

Figure 9:
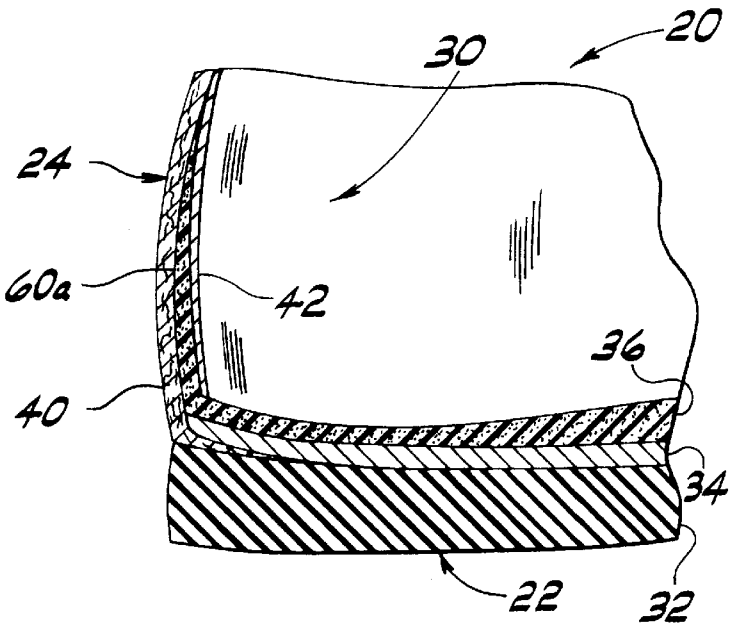
FIG. 9 is a cross section similar to FIG. 5 but showing the second embodiment of the present invention.
Figure 8:
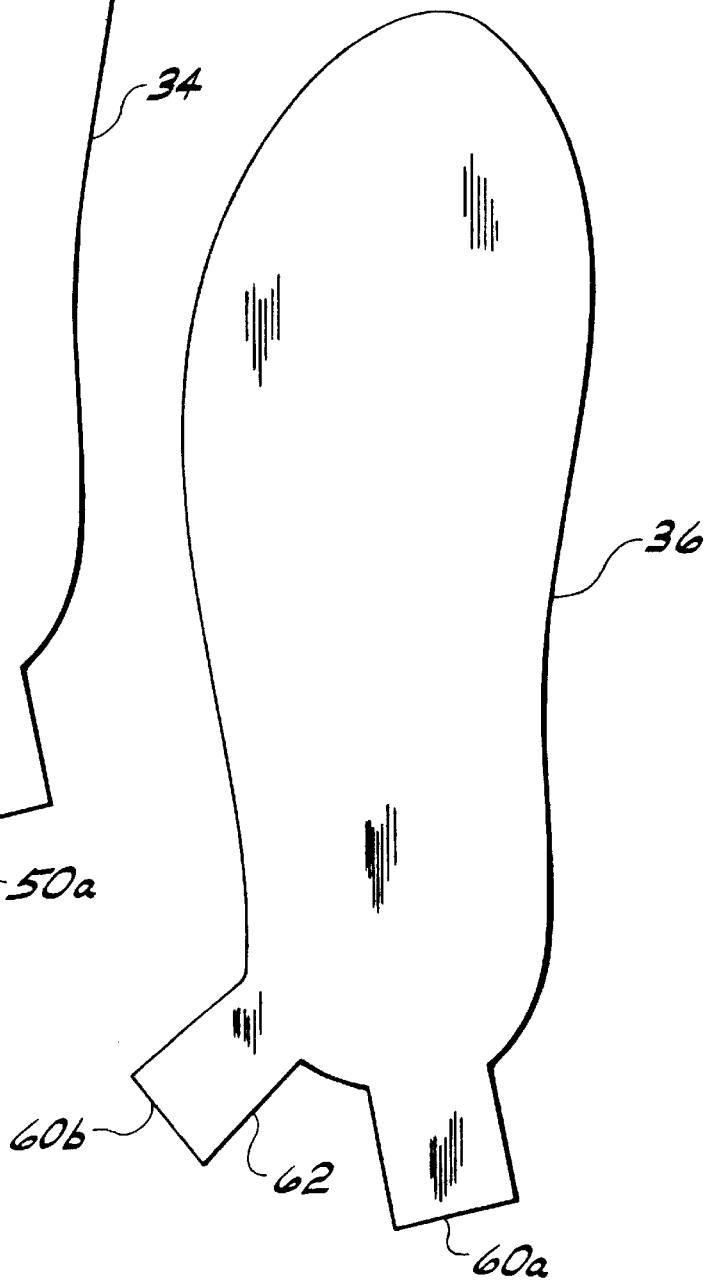
FIG. 8 is a top plan of an insole used in constructing a shoe of a second embodiment.

In a second embodiment illustrated in FIG. 8, the insole 36 has two spaced flaps 60*a*, 60*b* similar to the flaps 50*a*, 50*b* extending from the last board 34 of the first embodiment. The last board 34 of the second embodiment is conventional and does not include the flaps 50*a*, 50*b*. As shown in FIG. 9, the flaps 60*a*, 60*b* of the insole 36 extend up from the insole between the liner 42 and the outer shell 40 of the upper 24. The flaps 60*a*, 60*b* have substantially the same dimensions as the flaps 50*a*, 50*b* of the first embodiment and are separated by a space 62 having approximately the same width as the space 52 of the first embodiment. Further, as with the space 52 of the first embodiment, the space 62 between the flaps 60*a*, 60*b* of the insole 36 forms a recess (similar to that shown in FIG. 6) at the back of the heel cup 30 which is sized and positioned for receiving the lateral posterior portion LP of the heel bone C, the Achilles tendon A and the associated bursae B. Although other materials may be used without departing from the scope of the present invention, the insole 36 of the second preferred embodiment is made of neoprene, polyvinyl chloride or polyurethane having a Shore A durometer of about 35 to about 65 or a Shore C durometer of about 45 to about 65. As will be appreciated by those skilled in the art, the last board 34 of the second embodiment may be omitted without departing from the scope of the present invention.

Figure 10:
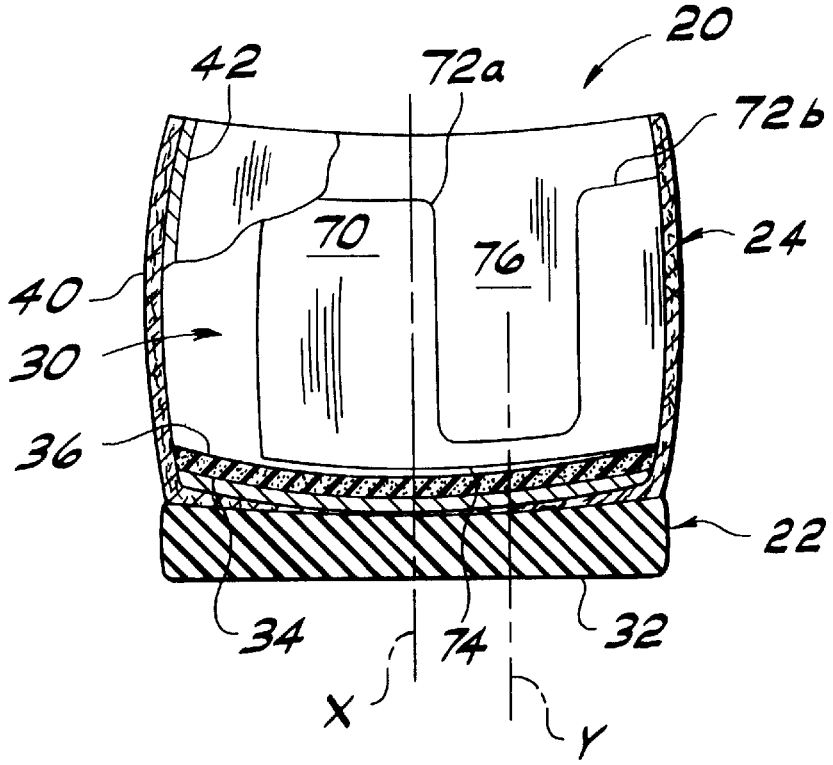
FIG. 10 is a cross section similar to FIG. 4 but showing a third embodiment of the present invention.

As illustrated in FIG. 10, a third embodiment of the present invention has a separate generally U-shaped insert 70 secured between the liner 42 and the outer shell 40 of the upper 24. The insert 70 comprises two spaced arms 72*a*, 72*b* integrally joined by a band 74. The facing (opposing) edges of the arms 72*a*, 72*b* are spaced apart to provide a recess 76 for receiving the lateral posterior portion LP of the heel bone C, the Achilles tendon A and the associated bursae B. As with the first and second embodiments, the recess 76 of the third embodiment is offset laterally from the longitudinal axis X bisecting the heel cup 30 so a portion of the foot F corresponding to the lateral posterior portion LP of the heel C protrudes into the recess 54. Further, the recess 76 has a width of between approximately 2.5 cm and approximately 3.5 cm, and the centerline Y of the recess is offset from the longitudinal axis X of the heel cup 30 by between about 1.0 cm and about 2.0 cm, depending on the size of the shoe. In addition, the recess 76 has a depth of approximately 0.05 cm and approximately 0.10 cm, and a height of between approximately 3.5 cm and approximately 4.5 cm, depending on the size of the shoe. Although the insert 70 may be made of other materials without departing from the scope of the present invention, the insert of the preferred embodiment is neoprene, polyvinyl chloride or polyurethane having a Shore A durometer of about 35 to about 65 or a Shore C durometer of about 45 to about 65.

Figure 11:
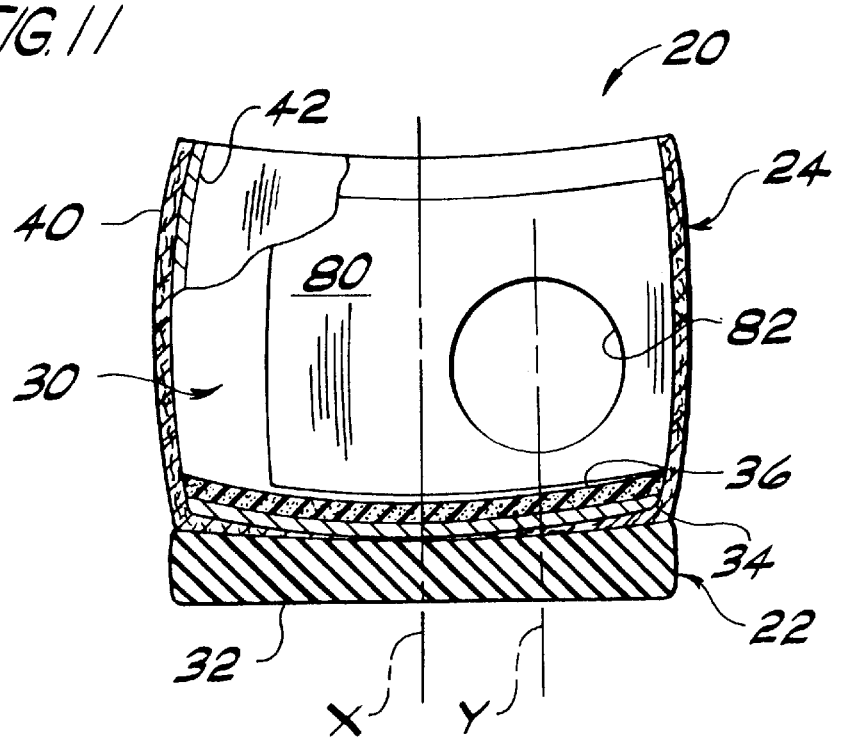
FIG. 11 is a cross section similar to FIG. 4 but showing a fourth embodiment of the present invention.

Referring to FIG. 11, a fourth embodiment of the present invention includes a generally rectangular insert 80 secured between the liner 42 and the outer shell 40 of the upper 24. The insert 80 has a oval opening 82 providing a recess for receiving the lateral posterior portion LP of the heel bone C, the Achilles tendon A and the associated bursae B. Although it is envisioned that other dimensions may be used without departing from the scope of the present invention, the oval opening 82 of the fourth preferred embodiment is between about 2.5 cm and about 3.5 cm tall and between about 2.5 cm and about 3.5 cm wide, depending on the size of the shoe. Further, the center of the oval opening 82 of the fourth preferred embodiment is positioned between about 2.0 cm and about 2.5 cm above the upper surface of the sole 22 and between about 1.0 cm and about 2.0 cm from the longitudinal axis X of the heel cup 30, depending on the size of the shoe. In addition, the opening 82 is between approximately 0.05 cm and approximately 0.10 cm deep, depending on the size of the shoe. Although the opening 82 of the preferred embodiment extends entirely through the insert 80, openings which extend only partially through the insert are also envisioned as being within the scope of the present invention. It is also contemplated that the opening 82 may be filled with a material which is more easily compressed than the material forming the surrounding portion of the insert 80. For instance, the filler material may be a gel (e.g., a silicone gel), a fluid held in a flexible hollow member or other material that is compliant to accommodate the lateral posterior portion LP of the heel bone C, the Achilles tendon A and the associated bursae B of a wearer's foot F (not shown). Although the insert 80 may be made of other materials without departing from the scope of the present invention, the insert of the preferred embodiment is neoprene, polyvinyl chloride or polyurethane having a Shore A durometer of about 35 to about 65 or a Shore C durometer of about 45 to about 65.

Figure 12:
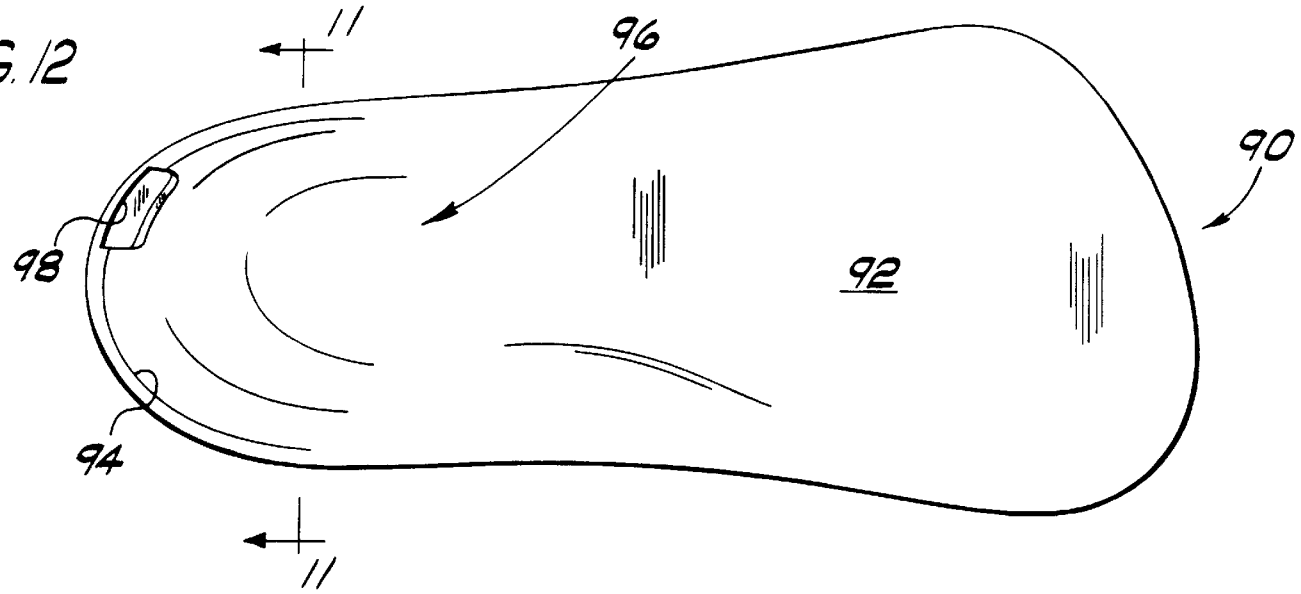
FIG. 12 is a top plan of an orthotic constituting footwear of a fifth embodiment of the present invention.
Figure 13:
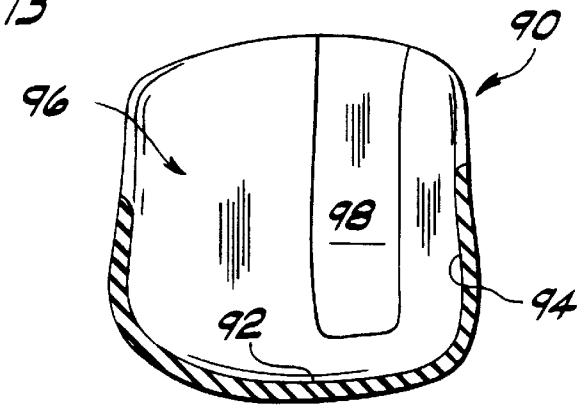
FIG. 13 is a cross section taken along line 13—13 of FIG. 12.

A fifth embodiment of the present invention, shown in FIGS. 12 and 13, comprises an orthotic, generally designated by 90, for placement in a shoe over its insole (not shown). The orthotic 90 has a conventional inner sole 92 for receiving a foot (not shown). A wall 94 surrounding the rearward portion of the inner sole 92 forms a heel cup, generally indicated at 96, for receiving the heel of the foot. A recess 98 formed in the wall 94 is sized and positioned as described above for accommodating the lateral posterior portion LP of the heel bone C, the Achilles tendon A and the associated bursae B of a wearer's foot F (not shown). The recess 98 is generally U-shaped, similar to the recesses of the first through third embodiments of the present invention, but may have other configurations without departing from the scope of the present invention. For instance, the recess may be oval or have other shapes. Also, the recess may extend entirely through the thickness of the wall. Although the orthotic 90 may be made of other materials without departing from the scope of the present invention, the insert of the preferred embodiment is neoprene, polyvinyl chloride or polyurethane having a Shore A durometer of about 35 to about 65 or a Shore C durometer of about 45 to about 65.

Figure 15:
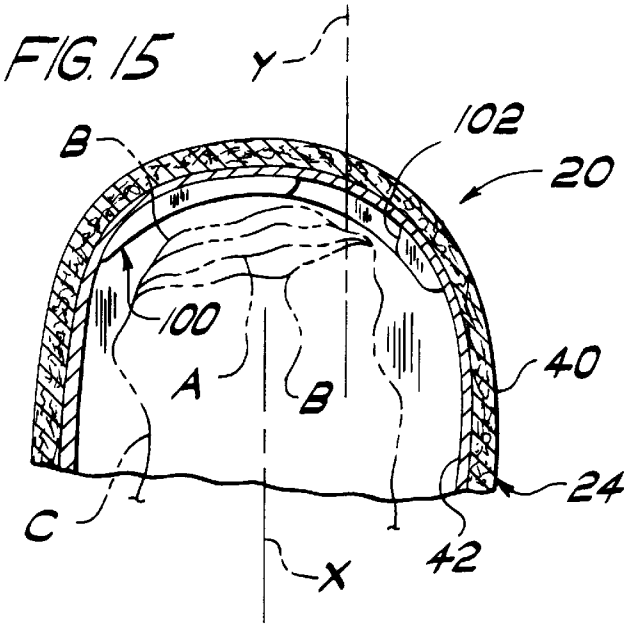
FIG. 15 is a top plan of a shoe showing the insert of the sixth embodiment installed in a shoe.
Figure 14:
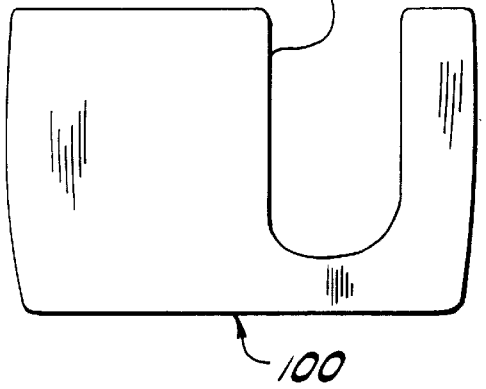
FIG. 14 is a front elevation of an insert constituting footwear of a sixth embodiment of the present invention.

FIGS. 14 and 15 illustrate a sixth embodiment of the invention. This embodiment comprises an adhesive backed insert, generally indicated at 100, formed with an opening (e.g., a slot 102) sized and shaped substantially the same as the insert 70 of the third embodiment. The insert 100 of the sixth embodiment may be affixed inside the heel cup 30 of a shoe 20 using its adhesive backing so the centerline Y of the slot 102 is offset from the longitudinal axis X of the heel cup 30 to accommodate the lateral posterior portion LP of the heel as discussed above. Although other materials may be used without departing from the scope of the present invention, the insert 100 of the sixth preferred embodiment is made of foam such as neoprene, polyvinyl chloride or polyurethane having a Shore A durometer of about 35 to about 65 or a Shore C durometer of about 45 to about 65.

Figure 16:
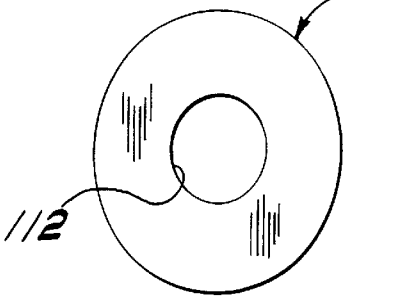
FIG. 16 is a front elevation of an insert constituting footwear of a seventh embodiment.

An oval or round, adhesive backed insert of a seventh embodiment of the present invention is generally designated by 110 in FIG. 16. The insert 110 has an oval opening 112 shaped similarly to the oval opening 82 of the fourth embodiment. The insert 110 may be positioned inside a shoe (not shown) so the center of the oval opening 112 is positioned between about 2.0 cm and about 2.5 cm above the upper surface of the sole 22 and between about 1.0 cm and about 2.0 cm from the longitudinal axis X of the heel cup 30 (not shown) to accommodate the lateral posterior portion LP of the heel bone C, the Achilles tendon A and the associated bursae B of a wearer's foot F (not shown). These dimensions may vary depending on the specific size of the shoe. Although other materials may be used, the insert 110 of the seventh preferred embodiment is made of foam similar to that of the sixth embodiment.

Figure 17:
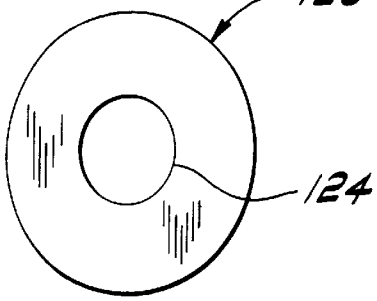
FIG. 17 is a front elevation of an insert constituting footwear of an eighth embodiment.

An oval or round, adhesive backed insert 120 comprising the eighth embodiment of the present invention is illustrated in FIG. 17. The eighth embodiment is identical to the seventh except that the opening 112 is filled with an oval compliant member 124 to accommodate the lateral posterior portion LP of the heel bone C, the Achilles tendon A and the associated bursae B of a wearer's foot F (not shown). Although other materials may be used without departing from the scope of the present invention, the compliant member 124 of the eighth preferred embodiment is made of gel similar to that of the fourth embodiment.

Figure 18A:
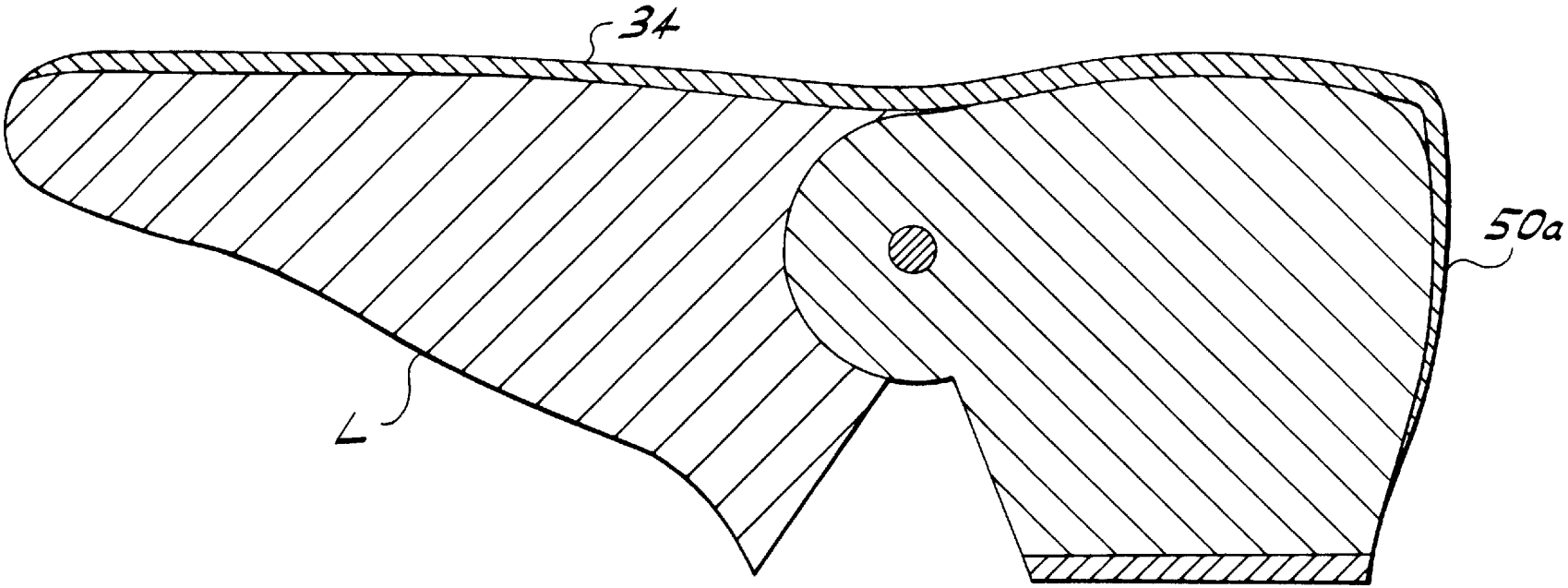
FIGS. 18*a*–18*c* depict steps of a method of making the shoe of the first embodiment.
Figure 18B:
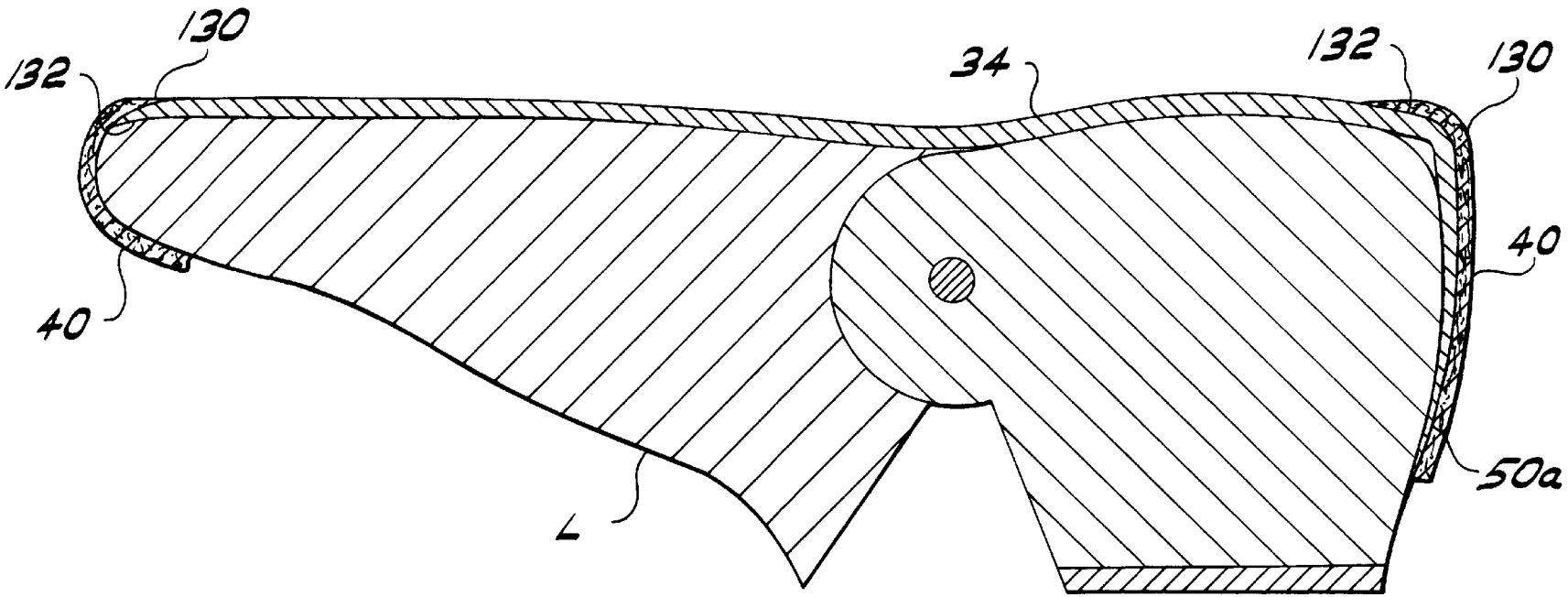
Figure 18C:
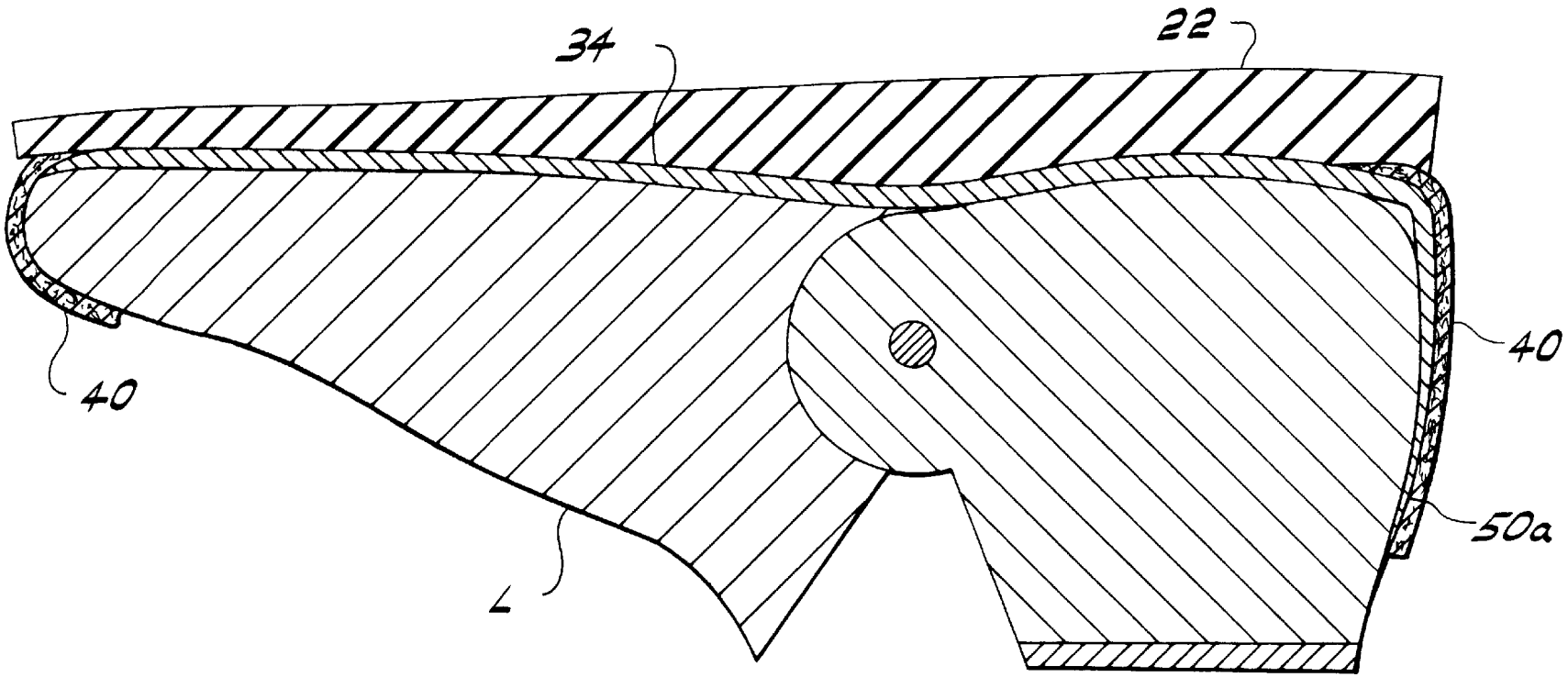

FIGS. 18*a*–18*c* depict steps of a method of making the shoe 20 of the first embodiment. First, a last board 34 is temporarily attached to a last (generally designated by L) in a conventional manner (e.g., with staples) as shown in FIG. 18*a*. The tabs 50*a*, 50*b* of the last board 34 are folded down over the heel portion of the last L, and an outer shell 40 of an upper 24 is slipped into position over the last L and last board as shown in FIG. 18*b*. When the outer shell 40 is in position, the margin 130 of the outer shell 40 overlies the margin 132 of the last board. These margins 130, 132 may be attached to each other by any conventional method if desired. As illustrated in FIG. 18*c*, a sole 22 is attached to the last board 34 and outer shell margin 130 by any conventional means (e.g., stitching and/or gluing). Once the sole 22 is attached to the outer shell 40 and last board 34, the partially completed shoe 20 is removed from the last L and the insole 36 and liner 42 are attached to the outer shell 40 and last board 34 in a conventional manner to complete the shoe 20 as shown in FIG. 5.

As will be appreciated by those skilled in the art, the shoe 20 of the second embodiment is made in much the same way as the shoe of the first embodiment. However, the last board 34 of the second embodiment does not have tabs. Thus, the step of folding the tabs down over the heel portion of the last L is omitted. Instead, the last board 34 is temporarily attached to the last L, the outer shell 40 is slipped into position over the last and last board, and the sole 22 is attached to the last board and outer shell margin 130 before the partially completed shoe 20 is removed from the last L. When the insole 36 is inserted into the shoe 20, the tabs 60*a*, 60*b* are folded up so they are positioned against the inside of the outer shell 40 or similar structure (e.g., a counter). The liner 42 is attached to the outer shell 40 so the tabs 60*a*, 60*b* of the insole 36 are sandwiched between the liner and the shell.

The shoes 20 of the third and fourth embodiments (FIGS. 10 and 11) are also made by a somewhat similar method. However, neither the last board 34 nor the insole 36 of these embodiments has tabs. Instead, the last board 34, outer shell 40 and sole 22 are the assembled as described above with respect to the second embodiment. The insert (70 or 80) is attached to the inside of the outer shell 40 or similar structure (e.g., a counter) before the liner 42 and insole 36 are inserted into the shoe 20.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Footwear comprising a sole having a front and a back for supporting a bottom of a foot, a heel cup at the back of the sole for receiving and supporting a heel of the foot, said heel cup having a bottom for further support of the bottom of the foot and a side wall extending up from the bottom, said side wall having a generally concave rear section for receiving and supporting the back of the heel and opposite side sections extending forward from the rear section, a recess in the rear section of the side wall of the heel cup offset laterally from a longitudinal central vertical plane of the heel cup to a position corresponding to the rearwardly protruding lateral posterior portion of the calcaneus of the foot and sized for accommodating the rearwardly protruding lateral posterior portion of the calcaneus of the foot.

2. Footwear as set forth in claim 1 further comprising an inserted member positioned in the rear section of the side wall of the heel cup, said member including the recess for accommodating the rearwardly protruding lateral posterior portion of the calcaneus of the foot.

3. Footwear as set forth in claim 2 wherein said heel cup comprises an inner layer, an outer layer, and said member is positioned between the layers.

4. Footwear as set forth in claim 2 wherein said footwear comprises a last board, and wherein said member comprises a pair of flaps extending up from the last board, said flaps being laterally spaced from one another to define said recess therebetween.

5. Footwear as set forth in claim 4 wherein said flaps are integral with the last board.

6. Footwear as set forth in claim 2 wherein said footwear comprises an insole, and wherein said member comprises a pair of flaps extending up from the insole, said flaps being laterally spaced from one another to define said recess therebetween.

7. Footwear as set forth in claim 6 wherein said flaps are affixed to the insole.

8. Footwear as set forth in claim 2 wherein said inserted member comprises a generally U-shaped member, said U-shaped member having two spaced-apart upwardly extending arms defining said recess therebetween.

9. An orthotic for placement in footwear, comprising a heel cup for receiving and supporting a heel of a foot, said heel cup having a bottom for supporting a bottom of the foot and a side wall extending up from the bottom, said side wall having a generally concave rear section for receiving and supporting the back of the heel and opposite side sections extending forward from the rear section, a recess in the rear section of the side wall of the heel cup offset laterally from a longitudinal central vertical plane of the heel cup to a position corresponding to the rearwardly protruding lateral posterior portion of the calcaneus of the foot and sized for accommodating the rearwardly protruding lateral posterior portion of the calcaneus of the foot.

10. An orthotic as set forth in claim 9 further comprising an insole formed as one piece with the heel cup and extending forward from the heel cup, said insole having an arch section immediately forward of the heel cup for supporting the bottom of the arch of the foot.

11. An orthotic as set forth in claim 10 further comprising a forefoot section forward of the arch section for supporting the bottom of the foot forward of the arch.

* * * * *